United States Patent [19]

Huff

[11] 4,031,568

[45] June 28, 1977

[54] LEGLESS PANTY

[75] Inventor: Bernice Huff, Hamilton, Ohio

[73] Assignee: The Procter & Gamble Company, Cincinnati, Ohio

[22] Filed: May 30, 1975

[21] Appl. No.: 582,491

[52] U.S. Cl. ..... 2/406; 2/402

[51] Int. Cl.[2] ..... A41B 9/04

[58] Field of Search ..... 2/224 A, 224 R, 225, 2/226, 238, 221, 237, 406, 402, 403

[56] References Cited

UNITED STATES PATENTS

| | | | |
|---|---|---|---|
| 1,277,006 | 8/1918 | Weis | 2/221 |
| 2,027,987 | 1/1936 | Reis | 2/224 A |
| 2,408,723 | 10/1946 | Arpin et al. | 2/224 A |
| 2,419,867 | 4/1947 | Woodman | 2/224 A |
| 3,237,625 | 3/1966 | Johnson | 2/224 A X |
| 3,488,778 | 1/1970 | Goujon et al. | 2/224 A |

*Primary Examiner*—H. Hampton Hunter

*Attorney, Agent, or Firm*—Elliot A. Lackenbach; John V. Gorman; Richard C. Witte

[57] ABSTRACT

Legless panty having elasticity around the leg openings thereof which is differentially tailored, as by the application of elastic bands thereto with portions of the elastic bands being prestretched to varying degrees during application, in a manner to gather only the edge portions adjacent the leg opening which in use lie generally along the wearer's groin while leaving smooth and ungathered those edge portions adjacent the leg openings which in use overlie the hips, to thereby provide a smooth outside appearance, reduce bunching under the buttocks and riding up thereon together with self-adjustable easing of the leg openings enabling expansion thereof outwardly from the groin to accommodate thighs of differing sizes and providing a pouch-like non-binding crotch portion firmly held in position by the elastic bands along the groin while readily accommodating natural bodily movements, without pulling, as during walking, sitting, bending, and the like.

8 Claims, 5 Drawing Figures

LEGLESS PANTY

FIELD OF THE INVENTION

This application pertains to undergarments and, more particularly, to legless women's panties. A panty as defined in Webster's New Collegiate Dictionary (1973) and as used herein, is "a woman's or child's undergarment covering the lower trunk and made with closed crotch and very short legs."

DESCRIPTION OF THE PRIOR ART

In bifurcated garments variations in tensioning circumferentially of tubular body or leg encircling portions are well known. Such variations in tensioning have generally been achieved by the use of elastic inserts or gores having an elasticity differing from the elasticity of the remainder of the leg encircling portion. It has also been previously suggested to secure an elastic band across a garment edge extending across both elastic and non-elastic panels. For example, in Palen U.S. Pat. No. 2,558,099 dated June 26, 1951 elastic bands are shown which extend across both horizontally stretchable panels and horizontally non-stretchable side inset panels. The elastic bands are attached to the horizontally elastic panels without prestretch and to the horizontally non-elastic side panels using prestretch to provide shirring and gathering of the leg opening edges of the horizontally inelastic side panels. The leg elastic bands of Palen provide gathering of the garment on the outer portions of the leg encircling panels and a smoothness on the inner portion of the leg encircling portion.

In structures of the type taught by the aforesaid Palen patent, however, the functional net result desired to be achieved is uniform tensioning of the generally tubular leg encircling portion in the completed garment. In other words, in the Palen type construction, two differing type fabric panels are utilized within the generally tubular leg encircling portions for various reasons and the elastic application is designed to compensate therefore and provide substantially uniform tensioning in the garment leg portion when it is worn. Hence, in the Palen type construction one of the panels defining the generally tubular leg encircling portion is horizontally elastic while another panel portion thereof is horizontally inelastic and the tensioning of the elastic band during application to the horizontally inelastic panel provides an elasticity thereto upon relaxation of the prestretch of the elastic band following application.

It has also been heretofore suggested to provide selective gathering of tubular portions of garments, by means of elastic bands sewn thereto along only a portion of their length. For example, Weis U.S. Pat. No. 1,277,006 dated Aug. 27, 1918 teaches placing an elastic band in a tunnel and stitching through the elastic band and the tunnel along a part of the band to cause the unstitched portion of the garment to be ruffled or gathered while the stitched portion will be left plain or free from gathers or ruffles.

Further, much effort has been expended by the foundation garment industry towards the development of foundation garments resistant to riding and creeping. Many generally complex, difficult to fabricate panel and band arrangements have been designed therefore such as, for example, as described in Martin U.S. Pat. Nos. 3,245,409 and 3,245,410 dated Apr. 12, 1966.

Legless panties, however, on the other hand do not have any generally tubular leg encircling panel portion to which the anti-ride and anti-creep design features of the prior art bifurcated garments can be applied. Further, they are conventionally made of lightweight, exceptionally supple fabrics. Therefore, the complex solutions to riding up of garments that have proved relatively effective in the more complex bifurcated foundation garments have no direct applicability to legless panties, and riding and bunching of these garments have generally been ignored as impossible of practical solution in such an essentially simple garment.

Additionally, nonwoven fabrics are becoming increasingly attractive because of their lower cost for many garment uses, including legless panties. Nonwoven fabrics, however, are relatively stiffer and less compressible than conventional knit lingerie fabrics, and when gathered tend to form more sharply defined creases. The use of conventional panty designs therefore, particularly around the leg openings, is not directly applicable and may result in folding and bunching along the outside edges of the leg openings which is particularly objectionable.

OBJECTS OF THE INVENTION

Bearing in mind the foregoing, it is a primary object of the present invention to provide novel legless panties constructed in accordance with the principles of the present invention which provide a smooth exterior appearance, are resistant to riding up, particularly on the buttocks and which are economical to manufacture while being yet durable and comfortable in use.

Another primary object of the present invention, in addition to the foregoing object, is the provision of novel and improved legless panties having elastic extending around the leg openings, prestretched to differing degrees at differing locations therearound during application.

Still another primary object of the present invention, in addition to each of the foregoing objects, is the provision of such legless panties having the leg opening elastic applied differentially around the leg openings in a manner providing gathering substantially entirely only adjacent the crotch region to provide a smooth, non-riding fit around the outside of the leg opening, non-binding in the crotch portion.

Yet another primary object of the present invention, in additon to each of the foregoing objects, is the provision of novel and improved legless panties providing a smooth appearance, comfortable fit and resistance to riding and creep.

A yet further primary object of the present invention, in addition to each of the foregoing objects, is the provision of novel and improved legless panties having the edges of the leg opening differentially tensioned to provide directed pull therealong towards the groin from both of the front and the rear directions.

It is another and still further primary object of the present invention, in addition to each of the foregoing objects to provide in a legless panty, or smoother fit along the outside of the leg by tensioning the leg opening edge towards the inside of the leg and thereby compensate for the tendency of stiffer fabrics of low compressability and low flexibility such as nonwovens, to irregularly bunch and form creases when gathered, as by elastic bands.

Yet still another primary object of the present invention, in addition to each of the foregoing objects, is the provision of novel and improved legless panties as set forth herein.

The invention resides in the combination, construction, arrangement and disposition of the various component parts and elements incorporated in new and improved legless panties constructed in accordance with the principles of this invention and especially of nonwoven or other relatively stiff fabrics of low compressability and low flexibility. The present invention will be better understood and objects and important features other than those specifically enumerated above will become apparent when consideration is given to the following details and description which, when taken in conjunction with the annexed drawing describes, discloses, illustrates and shows certain preferred embodiments or modifications of the present invention and what is presently considered and believed to be the best mode of practicing the principles thereof. Other embodiments or modifications may be suggested to those having the benefit of the teachings herein, and such other embodiments or modifications are intended to be reserved, especially if they fall within the scope and spirit of the subjoined claims.

SUMMARY OF THE INVENTION

In accordance with the present invention there is provided a legless panty having elasticity around the leg openings thereof which is differentially tailored, as by the application of elastic bands thereto with portions of the elastic bands being stretched to varying degrees during application, in a manner to generally gather only the edge portions adjacent the leg opening which in use lie generally along the wearer's groin while generally leaving smooth and ungathered those edge portions adjacent the leg openings which in use overlie the hips to thereby provide a smooth outside appearance. This construction reduces bunching under the buttocks and riding up thereon together with providing self-adjustable easing of the leg openings enabling expansion thereof outwardly from the groin to accommodate thighs of differing sizes and to also provide a non-binding pouch-like crotch portion firmly held in position by the elastic bands extending along the groin while readily accommodating natural bodily movement, without pulling, as during walking, sitting, bending, and the like. In accordance with a preferred embodiment of the present invention the gathering due to the elastic band is limited to approximately 62½% of the free length extent of the leg opening and the length of the gathered portion when relaxed is about 50% the ungathered pattern length forming that portion. The invention is of particular utility when applied to legless panties of nonwoven or other fabrics of low compressibility and low flexibility, stiffer than conventional lingerie fabrics but may be applied equally to the more flexible, more compressible and less stiff fabrics, such as conventional lingerie knits, or the like. Some slight tensioning or prestretch with some slight resultant gathering can, of course, be applied in the outer leg opening portion without departing from the present invention.

DESCRIPTION OF THE DRAWINGS

While the specification concludes with claims particularly pointing out and distinctly claiming the subject matter which is regarded as forming the present invention, it is believed the invention will be better understood from the following detailed description when taken in conjunction with the annexed drawing which describes, discloses, illustrates and shows a preferred embodiment or modification of the present invention and what is presently considered and believed to be the best mode of practising the principles thereof and wherein:

DETAILED DESCRIPTION OF THE INVENTION

Figure 1:
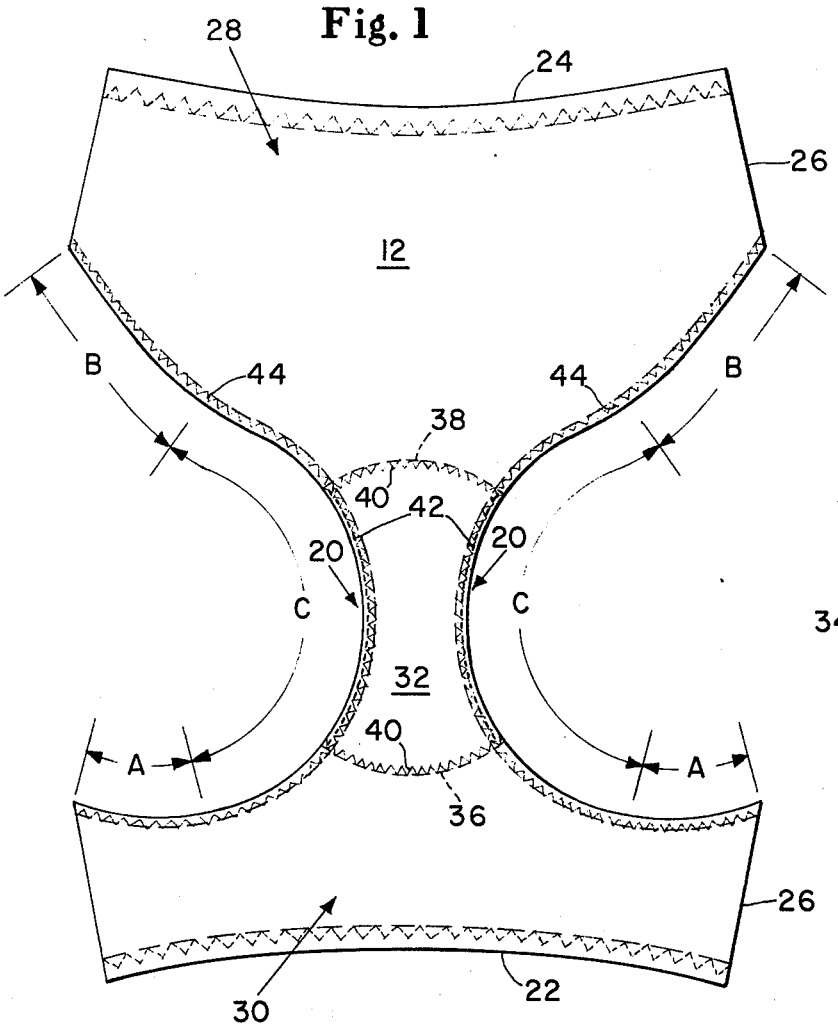
FIG. 1 is a plan view of a panty constructed in accordance with the present invention, opened at the side seams and spread flat with the elastic bands stretched to conform to the shape of the panty blank prior to elastic application thereto.

With reference now to the drawing there is shown and illustrated therein a legless panty designated generally by the reference character 10 fabricated of a generally H-shaped fabric panel or blank 12 to which there may, as will be described hereafter, be secured a crotch insert panel 14, a pair of leg elastic bands 16 and a waist elastic band 18.

Referring particularly to FIG. 1, the H-shaped fabric panel or blank 21 may be fabricated of substantially any type of material such as is conventionally utilized for the production of lingerie, or the like, such as, for example, tricot knit rayon or cotton jersey or may comprise a nonwoven fabric of bonded random laid melt spun nylon or other polymer filaments, or the like.

Figure 3:
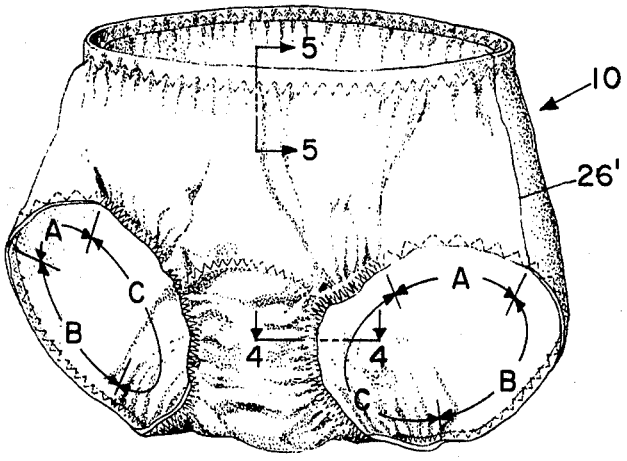
FIG. 3 is a perspective illustration of a completed and assembled panty brief from the blank of FIG. 1.
Figure 4:
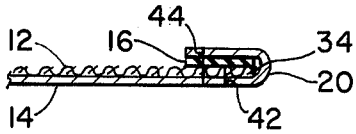
FIG. 4 is an enlarged partial cross secton view taken along line 4—4 of FIG. 3.
Figure 5:
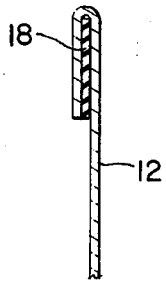
FIG. 5 is an enlarged partial cross section view taken along line 5—5 of FIG. 3.

The blank 12 may be of one-piece construction, as illustrated, or may comprise two or more panel portions seamed together in accordance with well known panty design and fabrication practice. It has been found, however, that in accordance with the present invention a one-piece generally H-shaped pattern, as shown in FIG. 1 provides suitable comfort and fit when the elastic bands 16 are applied along the edges 20 of the leg openings in accordance with the present invention. The blank 12, in addition to the edges 20 defining the leg openings, is also defined by a front waistline edge 22, a rear waistline edge 24 and side seam edges 26. As is shown, the front and rear waistline edges 22 and 24 are of generally curvilinear configuration with the side seam edges 26 being generally perpendicular thereto at the intersections therewith. The side seam edges are of equal length and are joined together in the assembled garment to define said seams 26' (FIG. 3).

Hence, the fabric panel or blank 12 generally comprises a rear or buttocks encompassing portion 28, a front or abdominal encompassing portion 30 and a crotch encompassing portion 32.

Although it is not essential to the present invention, it has been found that particularly where a relatively nonabsorbent material is utilized for the fabric length 12, such as spun bonded nonwoven fabric, that the crotch panel 14 be provided superposed over the crotch covering portion 32 and that the crotch panel 14 be fabricated of a highly absorbent yet air porous material, such as a cotton tricot knit such as is conventionally used in undergarments.

The side edges 34 of the crotch panel 14 may be generally coextensive with the subjacent portions of the leg opening edges 20, as indicated. The front and rear edges 36 and 38, respectively, of the crotch panel 14 may be generally convex, as shown, although the contours of such front and rear end edges are not critical to the present invention. The crotch panel 14 may be secured with the fabric panel or blank 12 in any convenient manner, as by means of lines of zig-zag stitching 40 and 42 adjacent the edges 36 and 38 and by means of lines of straight stitched stitching 42 adjacent the side edges 34 of the crotch panel 14.

Each of the side edges 20 defining the leg openings of the completed panty brief are of a generally hook shaped configuration on the blank 12, as shown in FIG. 1, and the elastic bands 16 are attached with the panel 12 along the hook shaped leg opening side edges 20, as by being bonded thereto or, as shown, by means of lines of zig-zag stitching 44 which also further secure the side edges 34 of the crotch panel 14.

In attaching the elastic bands 16 to the panel or blank 12, portions thereof are tensioned to differing degrees so as to provide differing degrees of gathering to the various portions of the leg opening and to direct the pull therealong generally towards the groin from both the front and the rear directions. The elastic bands 16 and 18 may be attached to the blank 12 while it is still in the flat, as illustrated in FIG. 1 and the side seam edges 26 then subsequently joined, to form side seam 26' (FIG. 3) or the side seams 26' may be first joined, and then the elastic bands 16 and 18 applied.

As indicated, the leg opening edges 20 may be divided into three regions, a front region extending from the side seam 26' generally forwardly a distance designated by the reference character A; a rear portion extending generally rearwardly from the side seam 26' a distance designated by the reference character B and a generally intermediate portion extending between the portions A and B a distance designated by the reference character C.

The forward portion A of the leg opening edge 20 is preferably equal to approximately ⅛ the total length of the leg opening edge 20. The rear portion B of the leg opening edge 20 is preferably equal to about one-fourth the total length of the leg opening edge 20. The intermediate portion C is preferably equal to approximately five-eighths of the total length of the leg opening edge 20.

In accordance with the present invention the portions A and B, which in the completed garment extend along the outside of the leg opening, have the elastic band 16 attached thereto generally continuously with little or no prestretch so that the portions of the fabric panel 12 adjacent the leg opening edge portions A and B are generally smooth and ungathered. The portion of the elastic band 16 secured along the edge portion C of the leg opening edge 20 is, however, in accordance with the present invention substantially prestretched when secured with the fabric panels 12 and 14. The bands 16 are preferably secured at a large plurality of closely spaced apart points while prestretched, tensioned or extended so that, upon relaxation thereof, substantial gathering or shirring of the fabric panels 12 and 14 occurs along the portions C, as shown in FIG. 3.

The elastic band 16 may be connected with the panels 12 and 14 by, for example, a continuous row of zig-zag stitching 44. Other mounting methods may be utilized, such as bonding, or the like, and it is also within the purview of the present invention to produce the gathering along the edge portion C by means other than prestretching of the elastic band 16 during attachment of the elastic band 16 to the panels 12 and 14 and subsequent relaxation. For example, the development of the gathering may be accomplished by utilizing a heat or otherwise shrinkable or unstable elastic band, attached to the fabric panel 12 in a nontensioned condition and subsequently shrunk, as by the application of heat, or the like, thereto, to reduce its length and produce the stretchable gathering of the edge portion of the fabric panel 12. Gathering may also be done prior to elastic application and the elastic then applied in an unstretched condition.

It has been found that an average overall leg opening tension of about 0.175 pounds provides, in general, the most comfort to a majority of women. Hence, this figure may be utilized as the design tension for a legless panty in accordance herewith. As a practical matter, however, a particular size of garment must fit a range of women's sizes, and identical tension cannot be developed for all women within the range of sizes fit by a particular panty size. Hence, in designing panties in accordance herewith, the design tension of 0.175 pounds may be used for the median sized women within the range of sizes a legless panty constructed in accordance with the present invention would fit.

It has also been statistically determined that the median leg circumference of women who wear a size 5 panty brief is about 21.7 inches; of women who wear a size 6 panty brief is about 23.1 inches and of women who wear a size 7 panty brief is about 24.4 inches.

EXAMPLE I

Figure 2:
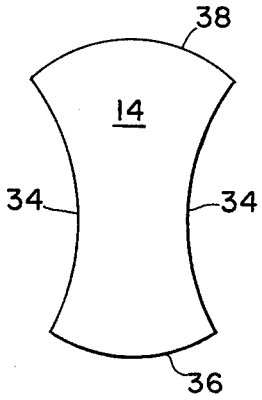
FIG. 2 is a plan view of a crotch insert for use in the panty of FIG. 1.

A size 5 legless panty was fabricated from a blank contoured as shown in FIG. 1 of Lutrabond 414 S, supplied by Lutravil Spinnviles GMBH & Co., 6750 Kaiserslautern-Einseidlerhof, West Germany, a nylon spun bonded nonwoven fabric of continuous textile denier filaments, typically about 3 denier, and an acrylic binder, partially bonded, stretched in the machine direction to contract it in the cross machine direction and then further bonded while in the stretched condition, having a basis weight of about 40–42 grams per square meter and an air porosity of about 300 cubic feet per square foot per minute at one half inch water, as measured by a Fraser test meter and a tensile strength of about 10–20 pounds per inch of width. This fabric was treated with glycerine to an add on weight of 10–15%, embossed at a temperature of 300° F and a pressure of 400 pounds per square inch between a twill weave bronze wire screen and a backing material of 80 durometer (Shore A scale) and final calendered at 250° F and 40 pounds per lineal inch, then prestretched to 150% of its original length and relaxed. A crotch panel contoured as shown in FIG. 2 of a lightweight cotton tricot knit fabric such as is conventionally used in underwear was used. The crotch panel 14 was sewn to the flat blank 12 by lines of zig zag stitching 40 at the ends of the crotch panel 14 and lines of straight stitching 42 along the sides thereof.

The length of the leg opening edge 20 was 22.4 inches and each of the leg opening elastic bands had a free length of 15.2 inches. The leg opening elastic bands consisted of a natural rubber compound in strips 0.250 inches wide and 0.007 inches thick, 386 yards per pound and having an elastic constant at 100% elongation of 150 grams, an elastic constant after three extensions to 100% elongation of 135 grams and a modulus of elasticity of 189 pounds per square inch.

The regions A and B were unstretched during sewing and were 2.8 and 5.6 inches in length, respectively. The remaining 6.8 inches of the elastic band was stretched to the 14 inch length of region C during sewing thereto which resulted in retraction of region C to almost its 6.8 inch free length after sewing, a gathering or retraction of 51.4%. The resultant legless panty was found by women customarily wearing size 5 panties to be comfortable and nonbinding around their legs and resistant to riding up on their buttocks.

EXAMPLE II

A size 6 legless panty was fabricated using the materials and procedures of Example I with the following variation.

The pattern or free length of the leg opening edge 20 of the blank 12 was 23.6 inches and the free length of the leg opening elastic bands were 16.2 inches. The unstretched regions A and B were 2.95 and 5.90 inches, respectively, and the region C therefore had a pattern length of 14.75 inches while the free length of the elastic band portion attached thereto was 7.35 inches, resulting in a gathering after sewing and relaxation of region C of 50.2%. The resultant panty was found by women customarily wearing size 6 panties to be comfortable and nonbinding around their legs and resistant to riding up on their buttocks.

EXAMPLE III

A size 7 legless panty was fabricated using the materials and procedures of Example I with the following variations.

The pattern length of the leg opening edge 20 of the blank 12 was 24.4 inches and the free length of the leg opening elastic bands were 17.1 inches. The unstretched regions A and B were 3.05 and 6.10 inches, respectively, and the regions C therefore had a pattern length of 15.25 inches while the free length of the elastic band portion attached thereto was 7.95 inches, resulting in a gathering after sewing and relaxation of region C of 47.9%. The resultant legless panty was found by women customarily wearing size 7 panties to be comfortable and nonbinding around their legs and resistant to riding up on their buttocks.

While the invention has been described, disclosed, illustrated and shown in terms of certain embodiments or modifications which it has assumed in practice, such other embodiments or modifications as may be suggested to those having the benefit of the teachings herein are intended to be reserved especially as they fall within the scope and breadth of the claims here appended.

What is claimed is:

1. In a legless women's panty having a hip encircling portion for extending completely around a wearer's torso and provided with leg openings with the edges thereof being elasticized and curvilinearly extending along the wearer's groin and generally outwardly over the wearer's hips and completely around the outside of the wearer's thighs, the improvement comprising means for differentially tailoring the elasticity along the leg opening edges, pulling the portion of the leg opening edges adjacent the groin outwardly against the inside of the wearer's legs and pulling the portion of the leg opening edges extending across the outside of the wearer's legs inwardly towards the wearer's groin, said means gathering said leg opening edges generally only along the groin to thereby provide a smooth outside appearance, reduce bunching under the buttocks and riding up thereon together with self adjustable easing of the leg openings outwardly of the groin to accommodate thighs of differing sizes, wherein said means comprises elastic band means extending substantially entirely along each of the leg opening edges secured thereto in a manner to gather said leg opening edges at least along the portions thereof lying along the wearer's groin while leaving the edge portions which in use overlies the hips and at least the outside of the wearer's legs smooth and ungathered, and elastically providing, during use, a directed pull of the leg opening edges extending about the wearer's legs towards the groin from both the front and the rear directions.

2. Legless panty defined in claim 1 wherein each said portion comprises approximately five-eighths of the unretracted length of the leg opening edge length.

3. Legless panty defined in claim 2 wherein the retraction of each said portion comprises approximately 50% of the portion free length.

4. Legless panty defined in claim 1 wherein said groin edge portions comprise approximately five-eighths of the unretracted length of the leg opening edge length.

5. Legless panty defined in claim 4 wherein the retraction of each said groin edge portion comprises approximately 50% of the portion free length.

6. Legless panty defined in claim 5 wherein said elastic band provides an average overall tension at a median sized leg opening extension of 0.175 pounds.

7. In a legless women's panty fabricated of a fabric panel having generally uniform stretch characteristics extending completely around the leg openings thereof, an elastic edging secured to said fabric panel along the edge of each leg opening entirely circumferentially thereof, said elastic edging being differentially tensioned relative said fabric to provide gathering of said fabric around said leg opening substantially only along approximately the inner five-eighths of the leg opening disposed adjacent the crotch portion of the panty and a smooth, non-gathered configuration along the remaining outer three-eighths of the leg opening edge.

8. Legless panty defined in claim 7 wherein the retraction of said gathered portion comprises approximately 50% of its free length.

* * * * *